US005205709A

United States Patent [19]

Schimmel et al.

[11] Patent Number: 5,205,709

[45] Date of Patent: Apr. 27, 1993

[54] FILAMENT WOUND DRUM COMPRESSOR ROTOR

[75] Inventors: William P. Schimmel, Milford; Irvin J. Pollock, Farmington Hills; Lawrence T. Halstead, Hartland, all of Mich.

[73] Assignee: Williams International Corporation, Walled Lake, Mich.

[21] Appl. No.: 856,569

[22] Filed: Mar. 24, 1992

[51] Int. Cl.[5] ..... T04D 29/04

[52] U.S. Cl. ..... 415/216.1; 29/889; 29/889.2

[58] Field of Search ..... 415/216.1; 29/889, 889.2

[56] References Cited

U.S. PATENT DOCUMENTS

| | | | |
|---|---|---|---|
| 1,042,323 | 10/1912 | Clarkson | 415/216.1 |
| 2,146,342 | 2/1939 | Koyemann | 29/889 |
| 2,308,307 | 1/1943 | Robinson | 415/216.1 |
| 2,637,521 | 5/1953 | Constantine et al. | 29/889.2 |
| 4,570,316 | 2/1986 | Sakamaki et al. | 29/889 |
| 4,938,064 | 1/1991 | Kawaguchi et al. | 29/889 |

FOREIGN PATENT DOCUMENTS

| | | | |
|---|---|---|---|
| 16283 | 1/1986 | Japan | 29/889 |

*Primary Examiner*—John T. Kwon
*Attorney, Agent, or Firm*—Lyon & Delevie

[57] ABSTRACT

A drum compressor rotor (10) for use in a gas turbine engine comprises a plurality of high strength, low density filaments (18*a–d*) which are covered with a high temperature adhesive resin and tightly wound around the hub (12) between rows of fan blades (14). The filaments allow an increase in the maximum compressor rotor operating speed thereby increasing the potential performance of the turbine engine. The filament windings (18a–d) are significantly lighter and less expensive than conventional welded metal support disks (106*a–c*).

8 Claims, 2 Drawing Sheets

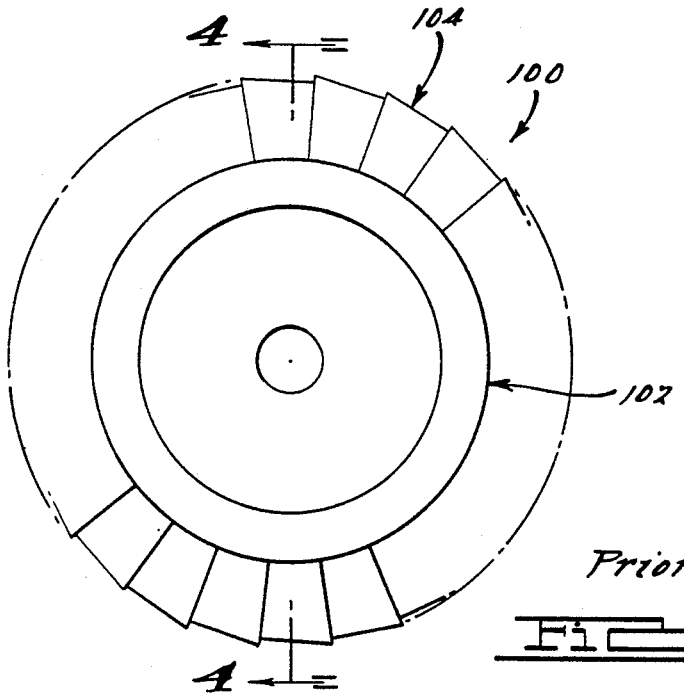
Prior Art
Fig. 3.
Prior Art
Fig. 4.
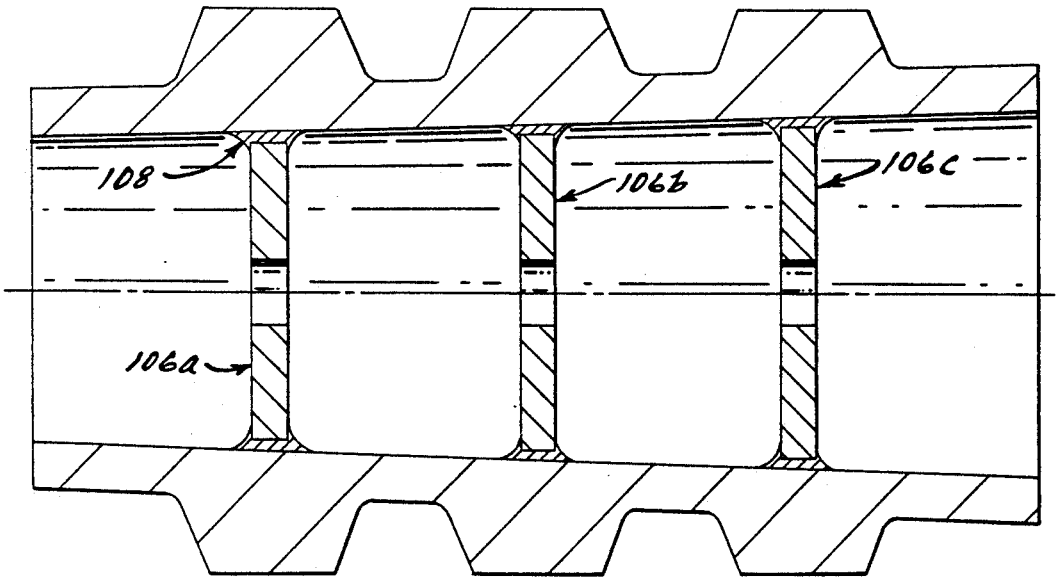

FILAMENT WOUND DRUM COMPRESSOR ROTOR

BACKGROUND OF THE INVENTION

The present invention generally relates to drum compressor rotors as used in gas turbine engines, and more particularly to an improved structural reinforcement of a drum compressor rotor.

Referring to FIGS. 3 and 4 there is shown diagrams of a basic drum compression stage rotor 100 for a gas turbine engine comprising a hub 102, fan blades 104 and a shaft (not shown) generally having an interference fit with the rotor hub 100. The compressor rotor is journaled within a housing and acts in conjunction with a compressor stator to generate very high velocity output airflow from a low velocity input airflow. The high velocity output airflow is subsequently fed to a combustor stage of the turbine. The rotor is typically one-piece cast with the shaft bore, mounting surface and blade tip diameters being machined. Basic cast material conventionally consists of a metal or metal alloy such as common steel, aluminum, nickel or titanium alloys.

Turbine compressor rotors typically operate at an extremely high rpm. A problem which generally arises to affect turbine performance is the strength-to-density ratio of the metal alloy employed in the rotor hub limits the rotor's maximum operating speed. As shown in FIGS. 3 and 4, the prior art in general has structurally reinforced the hub by welding metal or metal alloy disk supports 106(*a–c*) inside the hub to provide increased radial hub strength. This reinforcement of the hub increases the maximum operating speed of the rotor thereby permitting improved turbine performance.

However, the use of the metal or metal alloy disk supports has a drawback of being an expensive, complicated and time-consuming procedure when making the rotor. Each disk must be precisely located and held when welding to the hub. Further, since the inner surface of the hub is cast (i.e. a rough surface), the diameter of the disk supports must be slightly smaller than the inner hub surface. The weld is then made around the outer edge of the disk as a build up or filler (shown as 108 in FIG. 4 ). Thus, the structural support is limited to the strength of the weld.

The metal support disks also suffer the drawback of making the compressor rotor heavy. This added weight reduces turbine performance by increasing the amount of time to accelerate from rest to operating speed for the compressor rotor. The added weight is also undesirable due to the increase in the overall weight of the compressor.

SUMMARY OF THE INVENTION

It is therefore an object of the present invention to provide a lighter weight structural reinforcement for a drum compressor rotor.

It is also an object of the present invention to provide a stronger structural reinforcement for a drum compressor rotor.

It is further an object of the present invention to provide a structural reinforcement for a drum compressor rotor which is easier and less expensive to apply to the compressor rotor.

In accordance with the present invention, a drum compressor rotor for use in a gas turbine engine comprises a support means for supporting rotation of the rotor within the compressor, and a rotor hub mounted to the support means and having a plurality of rows of fan blades thereon. A plurality of high strength, low weight filaments are tightly wound axially around the rotor hub between the plurality of rows of fan blades. The high strength, low weight filaments are covered with a high temperature adhesive resin to hold the filaments around the rotor hub.

Also in accordance with the present invention, a method of structurally reinforcing a rotor hub of a compressor rotor used in a turbine engine comprises the steps of covering at least one high strength, low weight filament with a high temperature adhesive resin, and tightly winding the at least one filament axially around the rotor hub. A plurality of filaments can be tightly wound between rows of fan blades on the rotor hub.

The present invention will be more fully understood upon reading the following detailed description of the preferred embodiment in conjunction with the accompanying drawings.

BRIEF DESCRIPTION OF THE DRAWINGS

FIG. 3 shows a transverse sectional view of a conventional drum compressor rotor; and FIG. 4 shows a cross-section of FIG. 3 taken along the line 4—4.

DETAILED DESCRIPTION OF THE PREFERRED EMBODIMENT OF THE INVENTION

Figure 1:
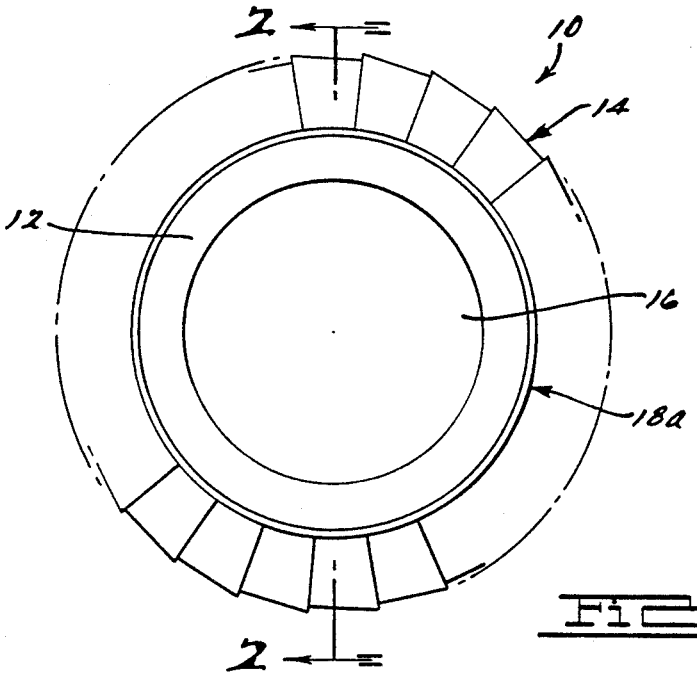
FIG. 1 shows a transverse sectional view of a drum compressor rotor in accordance with the present invention.

Referring to FIG. 1 there is shown a drum compressor rotor 10 for use in a gas turbine engine comprising a hub 12, plurality of fan blades 14 and a shaft bore 16. The hub 12 is a conventional one-piece cast which can have the shaft bore 16, mounting surfaces and blades machined as is well known in the art.

In accordance with the present invention, the compressor rotor 10 is structurally reinforced with a high strength, low weight filament winding 18 before assembly into the turbine compressor. Examples of possible filament material are carbon or Kevlar TM, but this is not to be construed as limiting. Turbine operating temperature will generally require a filament material which can handle high temperatures (e.g. 900° F.)

Figure 2:
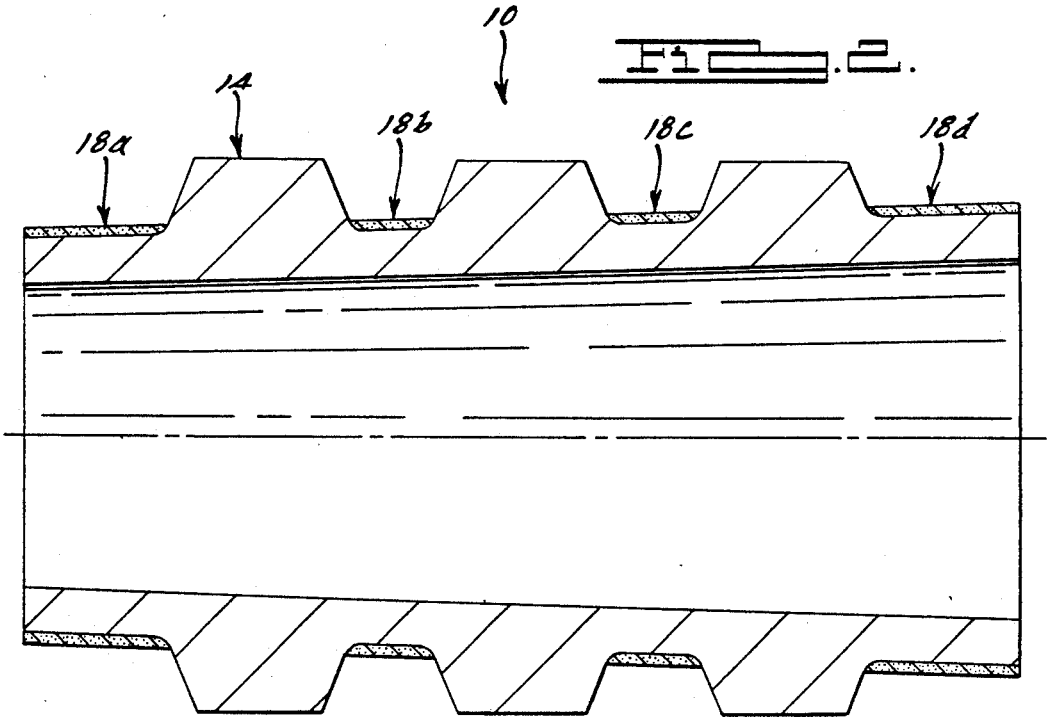
FIG. 2 shows a cross-section of FIG. 1 taken along the line 2—2.

In the preferred embodiment, the filament is covered with a high temperature adhesive resin (such as by running the filament through an epoxy resin bath) and then tightly wound around the rotor hub 12 to form a filament band. The winding can be applied to form a predetermined, desired tension on the rotor hub 12. In the preferred embodiment, a plurality of individual filament windings 18(a–d) can be placed around the hub 12 in the spacings between each row of blades as is shown in FIG. 2.

With the present invention, the filament winding material provides a significantly higher strength-to-density ratio than the prior art welded metal support disk. The higher strength-to-density ratio permits an increase in the maximum operating speed of the compressor rotor, thereby increasing the potential performance of a gas turbine engine. The low density/weight of the filament winding also lowers the total weight of the compressor rotor. Lower rotor weight reduces the amount of time required for the compressor rotor to accelerate from rest to operating speed. Lower rotor weight also lowers the total weight of the turbine engine. Further, manufacturing costs of the compressor rotor are significantly reduced due to the ease and speed of winding the filament around the casted compressor rotor hub as opposed to welding metal support disks inside the rotor hub.

It will be understood that the foregoing description of the preferred embodiment of the present invention is for illustrative purposes only, and that the various structural and operational features herein disclosed are susceptible to a number of modifications and changes, none of which departs from the spirit and scope of the present invention as defined in the appended claims.

I claim:

1. A drum compressor rotor for use in a turbine engine comprising:

a means for supporting rotation of said rotor within said compressor;

a rotor hub mounted to said support means, said hub having a plurality of rows of fan blades thereon;

a plurality of high strength, low weight filaments tightly wound axially around said hub, said plurality of filaments tightly wound between said row of fan blades respectively, said plurality of filaments structurally reinforcing said hub.

2. The drum compressor rotor of claim 1 wherein said plurality of high strength, low weight filaments are covered with an adhesive resin.

3. The drum compressor rotor of claim 2 wherein said adhesive resin comprises a high temperature epoxy resin.

4. The drum compressor rotor of claim 1 wherein said plurality of high strength, low weight filaments comprise carbon filaments.

5. A method of structurally reinforcing a rotor hub of a compressor rotor used in a turbine engine comprising the steps:

covering at least one high strength, low weight filament with an adhesive resin; and tightly winding said at least one filament axially around said hub.

6. The method of claim 5 wherein said rotor hub has a plurality of rows of fan blades thereon and said step of tightly winding further comprises tightly winding a plurality of high strength, low weight filaments axially around said hub, said plurality of filaments tightly wound between said plurality of rows of fan blades.

7. The method of claim 5 wherein said adhesive resin comprises a high temperature epoxy resin.

8. The method of claim 5 wherein said high strength, low weight filament comprises a carbon filament.

* * * * *